United States Patent [19]

Pehr

[11] Patent Number: 4,991,730

[45] Date of Patent: Feb. 12, 1991

[54] CAPTIVE KEY RELEASE CLOSURE STRUCTURE

[76] Inventor: Harold T. Pehr, P.O. Box 6698, Leawood, Kans. 66206

[21] Appl. No.: 406,169

[22] Filed: Sep. 12, 1989

[51] Int. Cl.[5] ..... B65D 50/14

[52] U.S. Cl. ..... 215/215; 215/238; 222/284

[58] Field of Search ..... 215/215, 202, 235, 236, 215/237, 245, 201, 206, 209, 213, 221, 250, 238; 220/339, 284; 222/543, 528

[56] References Cited

U.S. PATENT DOCUMENTS

| | | | |
|---|---|---|---|
| 3,811,563 | 5/1974 | Fox | 220/339 |
| 3,826,394 | 7/1974 | Stull | 215/224 |
| 3,828,959 | 8/1974 | Lerner | 215/322 |
| 3,854,622 | 12/1974 | McKirnan | 220/306 |
| 3,870,187 | 3/1975 | Bennett | 220/281 |
| 3,927,805 | 12/1975 | Stull | 215/238 |
| 4,278,178 | 7/1981 | Geiser | 215/215 |
| 4,353,483 | 10/1982 | Pehr | 222/153 |
| 4,378,073 | 3/1983 | Luker | 215/237 |
| 4,385,711 | 5/1983 | Bowen | 215/215 X |
| 4,393,976 | 7/1983 | Maguire | 215/215 X |
| 4,424,910 | 1/1984 | Heinol | 215/237 X |
| 4,555,035 | 11/1985 | Davis | 215/215 |
| 4,580,687 | 4/1986 | Lewis | 220/339 |
| 4,629,081 | 12/1986 | McLaren | 215/206 |
| 4,717,033 | 1/1988 | Dubach | 215/245 |
| 4,773,550 | 9/1988 | Ekkert | 215/235 X |
| 4,821,898 | 4/1989 | Smalley | 215/237 X |

FOREIGN PATENT DOCUMENTS

| | | | |
|---|---|---|---|
| 2499028 | 8/1982 | France | 215/253 |

OTHER PUBLICATIONS

Brochure of Knight Engineering & Molding Co., date unknown.

*Primary Examiner*—Stephen Marcus

*Attorney, Agent, or Firm*—Litman McMahon & Brown

[57] ABSTRACT

A captive key release closure structure includes a base ring for connection to a rim of a container, a closure member or cap integrally hinged to the base ring, latch indentations on an outer surface of a neck wall of the base ring, and latch pawls on an inner surface of a depending circumferential wall of the cap and aligned with the indentations. A key slot is formed in the cap wall at a position opposite the hinge, and a key receiving recess is formed in the base ring. The latch indentations and pawls are positioned in sets on opposite sides of the key slot and key recess. The closure structure is opened by insertion of a small keylike tool, such as a coin, spoon, or the like, and twisting against the surfaces forming the key slot and recess to separate and thereby release the pawls from the indentations.

14 Claims, 3 Drawing Sheets

Fig.6.
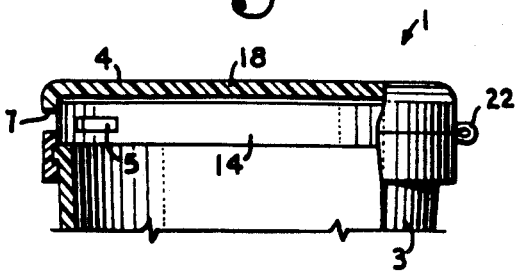
Fig.7.
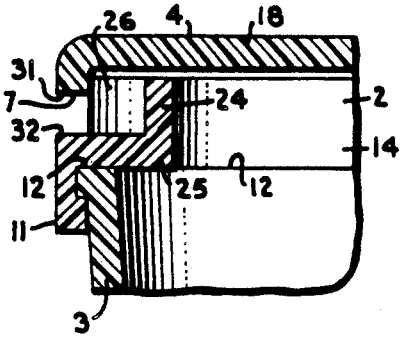
Fig.8.
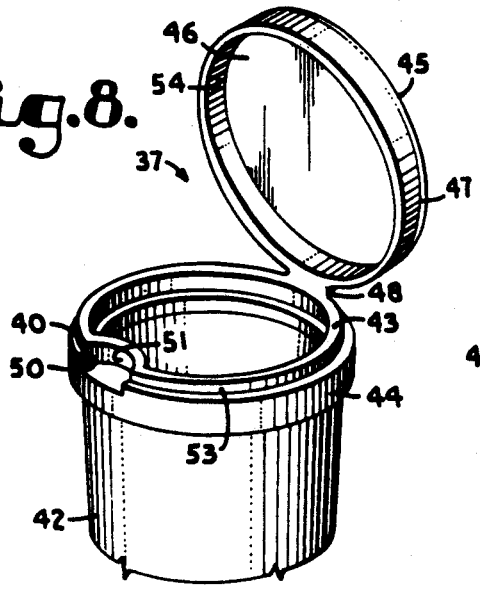
Fig.9.
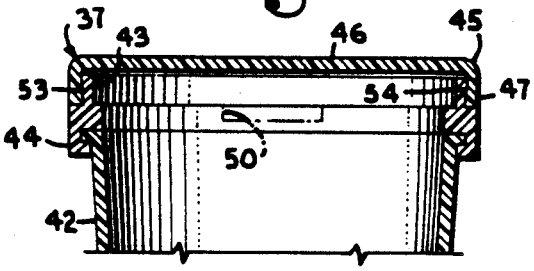
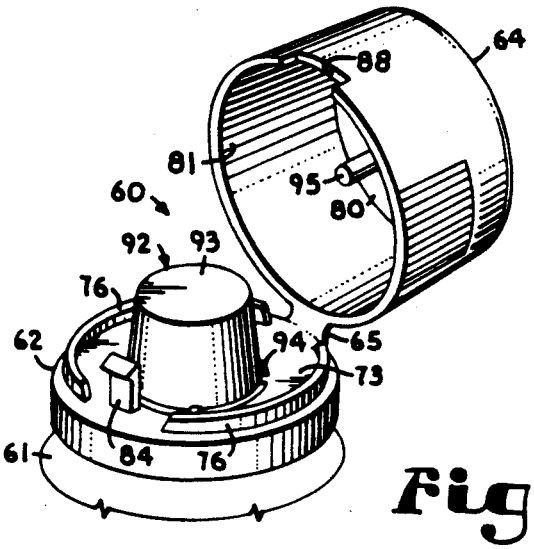
Fig.10.
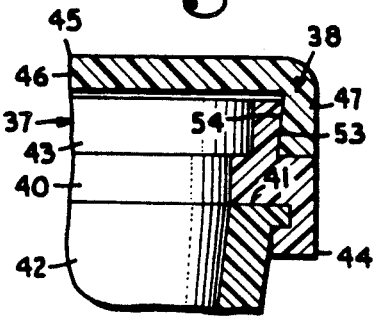
Fig.11.

CAPTIVE KEY RELEASE CLOSURE STRUCTURE

FIELD OF THE INVENTION

The present invention relates to closure devices for containers and, more particularly, to a hinged closure including a hidden latch which is released by twisting a key like device in a key slot of the closure.

BACKGROUND OF THE INVENTION

Many types of containers and closure devices therefor have been developed in an effort to prevent poisoning of and injuries to young children by the ingestion of hazardous contents of such containers or contact therewith. This has been particularly true with regard to prescription and over the counter drugs. The same principles are also desirable for containers of household chemicals such as detergents and other cleaners, solvents, paints, fuels and automotive types of fluids, lawn and garden chemicals, and the like. In general, the approach is to make a container difficult to open intuitively, but to provide printed instructions for opening the container which can be followed by someone mature enough to read and understand the opening instructions, as well as any warnings provided on the label.

Another goal of the container and packaging industries is to provide containers which will readily show evidence of prior tampering to a purchaser of products contained therein. The principal concern is safety, to prevent the contamination of ingestible products with harmful foreign materials. Another concern involved with tamper evident packaging is to inhibit in-store pilferage of packaged materials and to maintain customer good will by providing the full quantity of a product as listed on the package or container.

Most aerosol products involve some sort of hazard. The propellants for a considerable percentage of aerosol products are flammable, and most can be asphixiating in high concentrations in closed areas. Many products in aerosol form can be injurious, such as paints, cleaners of various types, insecticides, etc., by contact with the skin or eyes or if inhaled. To avoid these hazards and others, it is generally recommended that small children be prevented from handling and using aerosol containers. Child resistant caps to cover spray actuators of aerosol containers have been developed to inhibit operation of aerosol spray actuators. In one such type of child resistant aerosol cap, designated sides of the cap must be squeezed to distort an inner wall having a partial bead engaging a neck of the aerosol can to release the bead so that the cap can be twisted loose. In another type, a tool such as a screwdriver must be inserted through an aperture through an outer wall of the cap to release it.

One problem with most types of child resistant caps for aerosol containers is that once the cap is removed, it may be easily lost or discarded since it is not attached to the container. Once the cap is lost, the container is no longer child resistant and may thereafter be abused by a curious child, not aware of the possible dangers involved. Another problem with many conventional types of aerosol containers is that in a store, the product may be released by an irresponsible person, recapped, and replaced on the shelf and thereafter purchased by a customer not suspecting that the full quantity of product is not present.

SUMMARY OF THE INVENTION

The present invention provides a child resistant closure structure which is difficult to open by a young child with limited manual dexterity, but which can be opened using a simple tool by a more mature person. In general, the closure structure of the present invention is a captive, key release closure structure. The structure includes a base ring for affixing to a container, such as a medicine bottle, aerosol can, or the like, a closure member or cap integrally hinged to the base ring, a latch mechanism to retain the cap in the closed position, and a key slot between the base ring and cap which is sized to receive a simple tool, such as a coin, spoon, screwdriver, or the like which can be twisted to pryingly release the latch mechanism. The integral hinge arrangement, or captive nature of the cap, maintains the child resistant quality of the closure structure since the cap is not free to be misplaced once opened.

The present invention includes a low profile embodiment which is particularly adapted for containers such as small medicine bottles as are used for both prescription and some over the counter pharmaceuticals. The cap of the low profile closure is sized in diameter and height to just fit over a neck wall of the base ring of the structure. The key slot may be formed in either a depending wall of the cap or may be formed into the base ring and is positioned diametrically opposite the hinge. A preferred latch arrangement for the low profile closure includes a pair of indentations formed on an outside surface of the neck wall of the base ring on opposite sides of the position of the key slot and pawl wedges formed on an inner surface of the depending wall of the cap and positioned to align with the indentations. Alternatively, the indentations could be formed on the cap wall, and the pawl wedges could be formed on the neck wall of the base ring.

An alternative embodiment of the latch mechanism for the low profile key release closure structure is implemented by a so-called reverse draft relationship between the neck wall of the base ring and the depending wall of the cap. The outer surface of the neck wall has a frustoconical shape diverging upwardly. The inner surface of the cap wall is provided with a complementary frustoconical shape which converges downwardly. A key slot is formed between the cap and the base ring at a position opposite the hinge.

A closure structure incorporating either the pawl and indentation latch mechanism or the reverse draft latch mechanism is formed of a somewhat resilient plastic with enough resilience to allow the latch members to release when a key is twisted in the key slot. The degree of difficulty in opening such a structure can be controlled during manufacture by varying the thickness of the depending wall of the cap, the material employed, and the interengaging depth of the members of the particular latch mechanism.

The present invention also provides a high profile embodiment of the captive key release closure structure which is particularly adapted for aerosol containers. The high profile closure structure generally includes a base ring for assembly onto a neck rim of an aerosol can, a closure member or cap connected to the base ring by an integral hinge, a key release latch arrangement formed as cooperating components on the base ring and the cap, and a key slot formed between the cap and base to receive a key release tool. The base ring includes a top wall with an opening therethrough to accommodate the spray actuator of the aerosol can and a depending side wall having an inner ridge which snaps over the neck rim of the aerosol can.

A latch pawl projects upwardly from the top wall of the base ring opposite the hinge. A catch wedge is formed on an inner surface of the side wall opposite the hinge for engagement with the latch pawl on the base ring when the cap is closed. The latch pawl and catch wedge are, thus, hidden within the closure structure when the cap is closed. The latch arrangement is released to open the cap by inserting a simple tool into the key slot and twisting to snap the latch components past one another. The cap may then be pivoted about the hinge to an open position.

The high profile embodiment of the closure structure may be provided with various types of tamper evident features to indicate to a purchaser of a container incorporating the structure that the container has been previously tampered with. For use with aerosol containers having their own aerosol spray actuators, an actuator cover may be connected to the base ring by integrally molded and frangible tamper bars. The cover must be removed by breaking the tamper bars for access to the spray actuator. Alternatively, an integral spray actuator may be molded onto the base ring and connected by similarly frangible tamper bars. In this form, the tamper bars must be broken loose for use of the spray actuator.

The closure structure of the present invention is adapted for assembly with aerosol containers using automatic capping machines. To avoid undesired breakage of the tamper bars, the caps are provided with separation prevention pins or pegs positioned on the undersides of the end walls of the caps. The separation prevention pin engages the integral spray actuator cover or the integral spray actuator in the closed position of the associated caps to prevent the tamper evident features from being accidentally separated.

OBJECTS OF THE INVENTION

The principal objects of the present invention are: to provide an improved child resistant closure structure for containers; to provide such a structure which can be conveniently opened by mature persons, including adults with impaired dexterity; to provide such a structure incorporating a captive or hinged cap which is pivotal relative to a base of the structure which is connected to a container; to provide such a structure in which the cap is retained in a closed position by a latch arrangement which is released by twisting a key like object, such as a coin, in a key slot to pryingly release the latch; to provide such a structure in which the latch arrangement is hidden from view in the closed position of the cap; to provide a low profile embodiment of such a structure which is particularly well adapted for use on small prescription drug type containers; to provide a high profile embodiment of such a structure which is particularly well adapted for use on a conventional aerosol container or can without modifications thereto; to provide such a high profile structure which incorporates tamper evident features; to provide such a structure which is adapted for assembly on an aerosol can without damage to or separation of the tamper evident features; to provide such a structure including an aerosol spray actuator cover which is frangibly integral with the base ring of the structure and a pin on an inner side of a top wall of the cap which engages the cover in the closed position of the cap to prevent separation of the cover when the structure is assembled onto an aerosol can; to provide a modified embodiment of such a structure including an aerosol spray actuator which is frangibly integral with the base ring along with a separation prevention pin on the cap; to provide a variety of latch arrangements for such a key release closure structure which are adaptable to various sizes and types of containers; and to provide such a captive key release closure structure which is economical to manufacture, effective and convenient in use, and which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification, include exemplary embodiments of the present invention, and illustrate various objects and features thereof.

BRIEF DESCRIPTION OF THE DRAWINGS

FIG. 6 is a fragmentary side elevational view of the low profile key release closure with portions broken away to illustrate details thereof.

FIG. 7 is a greatly enlarged fragmentary radial sectional view of the low profile key release closure and illustrates details of the key slot and key receiving recess therebehind.

FIG. 8 is a fragmentary perspective view of a reverse draft embodiment of the low profile key release closure which incorporates a reverse draft latch arrangement.

FIG. 9 is an enlarged fragmentary diametric sectional view of the reverse draft key release closure.

FIG. 10 is a greatly enlarged fragmentary radial sectional view of the reverse draft key release closure and illustrates details of reverse draft latch arrangement.

FIG. 11 is a fragmentary perspective view of a high profile embodiment of the key release closure of the present invention employing a modified latch arrangement and shown installed on an aerosol container.

DETAILED DESCRIPTION OF THE INVENTION

Figure 1:
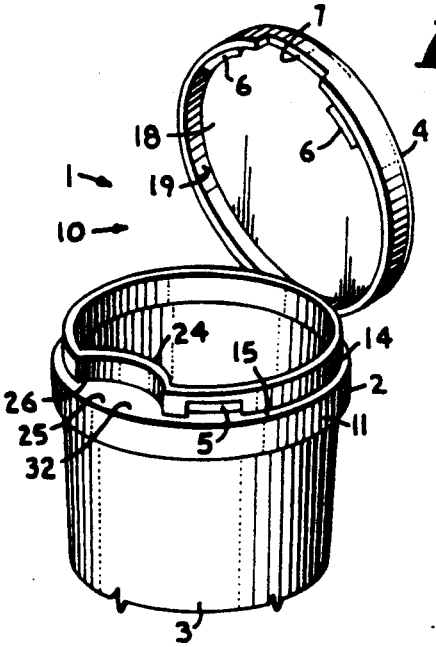
FIG. 1 is a fragmentary perspective view of a low profile embodiment of a captive key release closure structure embodying the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring the drawings in more detail:

The reference numeral 1 generally designates a captive key release closure structure embodying the present invention. The structure 1 generally includes a base ring or base 2 adapted to be attached to a container 3 and a closure member or cap 4 hinged to the base 2 and sized and positioned to close upon the base 2 to seal the container 3. The structure 1 is provided with latch members 5 and 6 formed respectively on the base 2 and cap 4 which cooperate to retain the cap 4 in a closed position on the base 2. The structure 1 is also provided with a key slot 7 positioned relative to the base 2 and cap 4 such that when the cap 4 is in the closed position, it may be opened by twisting a common tool, such as a coin, spoon, or the like, in the key slot 7 to pry the latch members 5 and 6 apart to release same and allow the cap 4 to be pivoted to an open position.

FIGS. 1–7 illustrate a preferred low profile embodiment 10 of the captive key release closure structure 1. The base ring 2 includes a mounting collar 11 which is adapted to snap over a rim 12 of the container 3. The container 3 may, for example, be a vial or bottle of the type in which prescription drugs are dispensed. A circumferential neck wall 14 projects upwardly from the collar 11 and has a diameter slightly less than that of the collar 11 to define an upwardly facing shoulder 15 on top of the collar 11.

The cap 4 includes a circular end wall 18 having a cylindrical wall 19 depending from a periphery thereof. The wall 19 has a lower surface 20. The cap 4 is hingedly connected to the base ring 2 by a hinge member 22 connected between the collar 11 of the base ring 2 and the depending wall 19 of the cap 4. Preferably, the base ring 2, cap 4, and hinge member 22 are formed integrally, as of a somewhat flexible and resilient plastic. The depending wall 19 has a diameter slightly greater than that of the neck wall 14 whereby when the cap 4 is closed, the cap wall 19 fits snugly about the neck wall 14 to seal the container 3 by engagement of the surface 20 of the cap 4 with the shoulder 15 of the base 2. The surface 20 and shoulder 15 also form an interface 33 between the cap 4 and base ring 2 when the cap 4 is in the closed position.

A recess portion 24 of the neck wall 14 is curved inwardly at a position opposite the hinge 22, and the shoulder 15 is extended inwardly to form a recess base wall 25 connecting with the recess wall 24. The recess wall 24 and recess base wall 25 define a key receiving recess 26. The key slot 7 is rectangular in shape, and in the illustrated low profile structure 10, the key slot 7 is formed in the depending wall 19 of the cap 4 at a position opposite the hinge 22. The key receiving recess 26 aligns with the key slot 7 when the cap 4 is in the closed position and provides clearance behind the slot 7 to receive a key like tool used to open he cap 4. The illustrated key slot 7 is sized to receive a key like tool, such as a U. S. five cent coin or nickel. This size is appropriate for receiving other common household items, such as a handle tip of a spoon, a table knife, a screwdriver, or the like for use in prying the cap 4 open.

Figure 2:
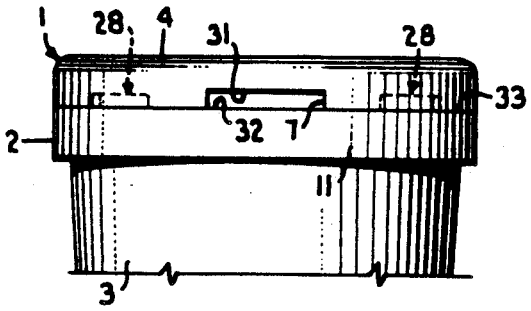
FIG. 2 is an enlarged fragmentary front elevational view of the low profile key release closure.
Figure 3:
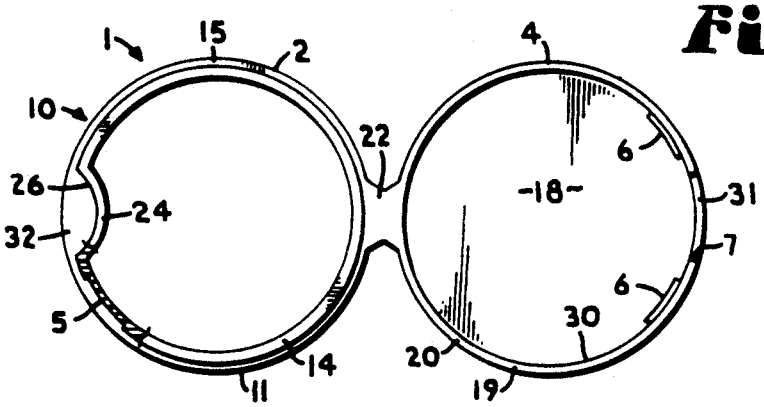
FIG. 3 is a top plan view of the low profile key release closure, shown in an open orientation.

A preferred embodiment of a key release latch mechanism 28 is illustrated in FIGS. 1–7. In the latch mechanism 28, a pair of latch indentations 5 are formed an outer surface 29 of the neck wall 14 on opposite sides of the recess 26. A pair of latch pawl wedges 6 are formed on an inner surface 30 of the depending cap wall 19 on opposite sides of the key slot 7 and positioned to align with the indentations 5. When the cap 4 is pivoted to the closed position, as shown in FIG. 2, the pawl wedges 6 snap into the indentations 5 to retain the cap 4 in the closed position. In order to release the latch mechanism 28, a keylike tool (not shown) is inserted into the recess 26 through the key slot 7 and twisted to engage a lower surface 31 of the key slot 7 and an upper surface 32 of the recess base wall 25. Usually, such an action will release both latches 28. However, it may be necessary under some circumstances to twist the keylike tool first in one direction and then the opposite direction to fully release both latches 28.

While the illustrated low profile captive key release closure structure 10 is illustrated as separate from the container 3, it could also be formed integrally therewith. And while the container 3 is illustrated as a cylindrical or frustoconical medicine type vial, it could other types of containers of different shapes, such as rectangular or the like. Finally, while the key slot 7 is illustrated as being formed in the wall 19 of the cap 4, it could be formed entirely within the base ring 2 or have portions formed in the cap wall 19 and the base ring 2.

FIGS. 8–10 illustrate a modified embodiment 37 of the low profile captive key release closure structure which incorporates a so-called reverse draft type of latch mechanism 38. The reverse draft closure structure 37 is similar in most respects to the low profile key release structure 10 except for aspects related to the latch mechanism 38. The structure 37 includes a base ring 40 adapted to snap over the rim 41 of a container 42, such as a medicine vial. The base ring 40 includes a circumferential neck wall 43 which is inset radially from a mounting collar 44 of the base 40. A closure member or cap 45 includes an end wall 46 with a depending cylindrical wall 47. The cap 45 is attached to the base ring 40 by a hinge member 48 which, preferably, is integral with the cap 45 and base ring 40.

A key slot 50 is formed in the base ring 40 at a position opposite the hinge 48 and has a key receiving recess 51 formed inwardly thereof. As is illustrated in FIG. 8, there is no portion of a key slot formed in the cap 45. However, the key slot 50 could alternatively be formed in the wall 47 of the cap 45 in combination with a recess 51 in the base ring 40, in the manner illustrated in FIG. 1 for the closure structure 10. Similarly, the key slot 50 could be divided between the base ring 40 and the cap 45. The key slot 50 provides for opening the cap 45 from its closed position upon the base ring 40 by the insertion of a keylike tool into the slot 50 and twisting to separate portions of the latch mechanism 38.

The latch mechanism 38 is referred to as a reverse draft type of latch because the draft angles of an outer surface 53 of the neck wall 43 and an inner surface 54 of the depending wall 47 of the cap 45 are opposite to that which would allow the cap 45 to be freely opened. The surfaces 53 and 54 are complementarily frustoconical such that when the cap 45 is closed upon the base ring 40, the surface 54 of the cap wall 47 snaps past the surface 53 of the neck wall 43 and, thus, retains the cap 45 in the closed position. The surfaces 53 and 54 comprise components of the latch mechanism 38. It is not essential that the conical contours of the surfaces 53 and 54 extend completely about the neck wall 43 and cap wall 47 respectively. However, such complete encirclement of the contours 53 and 54 contributes to sealing of the container 42. The degree of difficulty to opening the cap 45 can be controlled during manufacture of the structure 37 by the choice of materials, the wall thickness of the cap 47, and the conical angles of the surfaces 53 and 54. In most other respects, the closure structure 37 is substantially similar to the structure 10.

Figure 12:
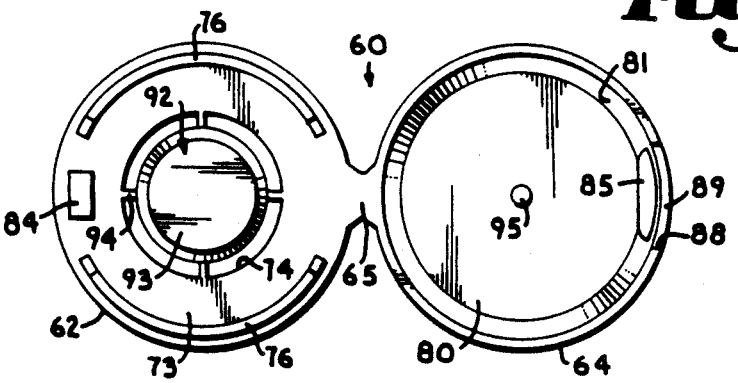
FIG. 12 is a top plan view of the high profile key release closure, shown in an open orientation.
Figure 13:
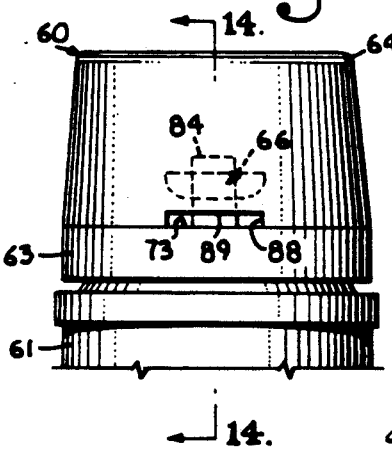
FIG. 13 is a front elevational view of the high profile key release closure.
Figure 15:
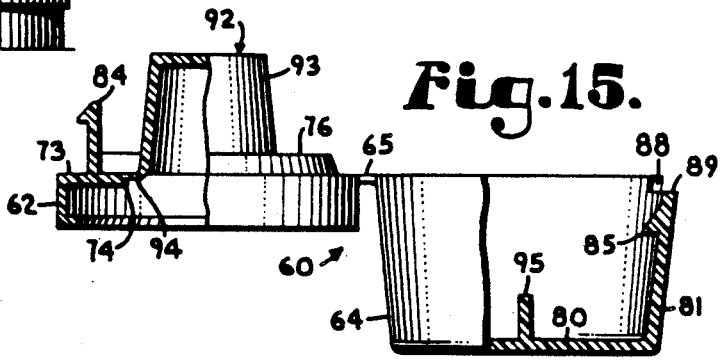
FIG. 15 is a side elevational view of the high profile key release closure, shown in an open orientation and with portions broken away to illustrate details thereof.

FIGS. 11–15 illustrate a high profile embodiment 60 of the captive key release closure structure which is particularly well adapted for capping containers such as aerosol cans 61. The high profile structure 60 includes a base ring 62 adapted for snapping over a neck rim 63 (FIG. 14) of the aerosol can 61, and a closure member or cap 64 connected by a preferably integral hinge 65 to the base ring 62. The cap 64 is retained in a closed position by a latch mechanism 66 (FIG. 13).

The base ring 62 includes an upper wall 73 having a circular opening or aperture 74 centered therethrough to accommodate an aerosol spray actuator 75 of the aerosol can 61. A bead or low wall 76 extends about a periphery of the base ring 62 except at a position opposite the hinge 65 to prevent releasing the latch mechanism 66 by sliding the cap 64 laterally. The cap 64 includes an end wall 80 having a cylindrical or somewhat conical side wall 81 depending therefrom. The side wall 81 has a height sufficient to accommodate the aerosol spray actuator 75. The hinge 65 connects between an edge of the upper wall 73 of the base ring 62 and an edge of the side wall 81 of the cap 64. The illustrated latch mechanism 66 includes a latch pawl 84 upstanding from the upper wall 73 of the base ring at a position opposite the hinge 65 and a catch member 85 formed on an inner surface of the cap wall 81 and positioned to align with the pawl 84. When the cap 64 is pivoted to the closed position, the catch 85 snaps past the pawl 84 to retain the cap 64 in the closed position.

A key slot 88 is formed in the cap wall 81 at a position opposite the hinge 65 and near the latch mechanism 66. The key slot 88 is sized to receive a keylike tool which is inserted and twisted to pry apart and release the catch 85 and pawl 84 to open the cap 64. Such a keylike tool bears against the upper wall 73 of the base ring 62 in the area to the pawl 84 and an upper surface 89 of the key slot 88. The degree of difficulty in releasing the latch mechanism 66 can be controlled during manufacture of the structure 60 by varying the wall thickness of the side wall 81, the thickness of the pawl 84, the selection of materials for their construction, and the biting depth of the pawl 84 and catch 85.

It should be noted that the key slot 88 could alternatively be formed entirely as a recess into the base ring 62, or portions of the key slot 88 could be in both the base ring 62 and the cap wall 81. The high profile key release closure structure 60 could alternatively be provided with another type of latch mechanism, such as one similar to the latch mechanism 28 of the structure 10 or the reverse draft type of latch mechanism 38 of the structure 37.

Figure 5:
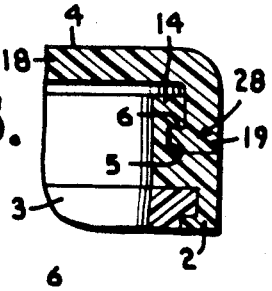
FIG. 5 is a greatly enlarged fragmentary radial sectional view of the low profile key release closure and illustrates details of a latch mechanism thereof.
Figure 4:
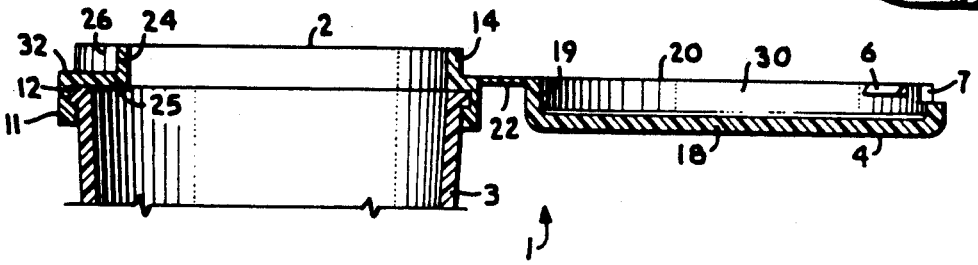
FIG. 4 is an enlarged fragmentary diametric sectional view of the low profile key release closure, shown in the open orientation.
Figure 14:
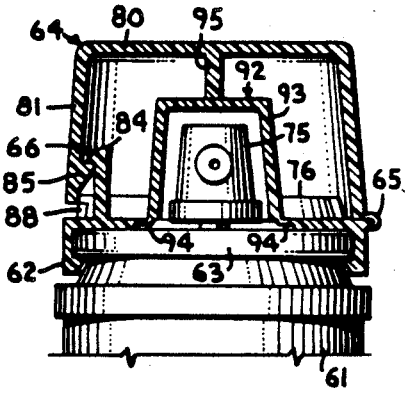
FIG. 14 is a diametric sectional view of the high profile key release closure taken on line 14—14 of FIG. 13 and illustrates details of cooperation between components of the closure and an aerosol container.

The high profile key release closure structure 60 is preferably provided with a tamper evident arrangement 92 to alert a consumer buying a product housed in the container 61 that the product may have previously been tampered with. As illustrated in FIGS. 12, 14, and 5, the tamper evident arrangement 92 is embodied as a spray actuator cover 93 which is molded integral with the structure 60. The cover 93 is connected to the upper wall 73 of the base ring 62 by frangible ribs or tamper bars 94 extending between the cover 93 and a surface forming the opening 74. The ribs 94 must be broken and the cover 93 removed to enable access to the spray actuator 75. A legend should be printed on a label of the container 61 or the cap 64 to alert the buyer to the expected presence of the tamper evident cover 93. In order to assure that the ribs 94 are not unintendedly broken before the closure structure 60 is even placed on the container 61, as by an automatic capping machine, the structure 60 is provided with a peg or pin 95 extending from the end wall 80 of the cap 64. As is illustrated in FIG. 14, the pin 95 contacts the cover 93 in the closed position of the cap 64 and prevents movement between the cover 93 and the base ring 62 which could break the ribs 94.

Figure 16:
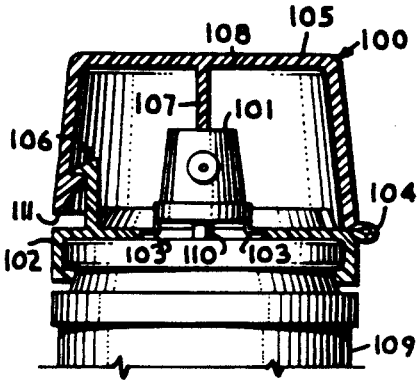
FIG. 16 is a diametric sectional view of a second high profile embodiment of the key release closure which is provided with a frangibly integral aerosol spray actuator.
Figure 17:
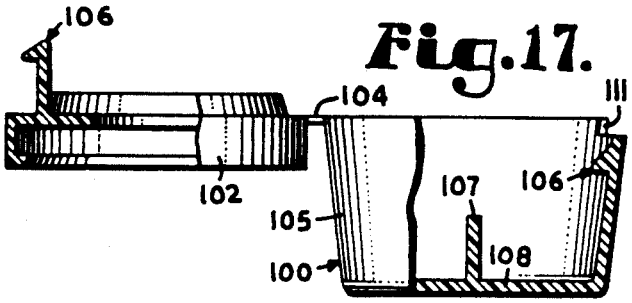
FIG. 17 is a side elevational view of the second high profile key release closure, shown in an open orientation and with portions broken away to illustrate details thereof.

FIGS. 16 and 17 illustrate a high profile key release closure structure 100, which is substantially similar to the structure 60. The principal difference is that a spray actuator 101 is molded integral with a base ring 102 of the structure 100. The actuator 101 is connected to the base ring 102 by frangible ribs 103. The base ring 102 is connected by an integral hinge 104 to a closure member or cap 105. The cap 105 is retained in a closed position by a latch mechanism 106, similar to the latch mechanism 66 of the structure 60. The cap 105 is provided with a separation prevention pin or peg 107 extending from an end wall 108 of the cap 105 which engages the actuator 101 when the cap 105 is in its closed position to prevent the actuator 101 from being unintentionally separated from the base ring 102, as during capping of a container 109 by an automatic capping machine to position the structure 100 on an aerosol container 109 and the actuator 101 on an aerosol valve stem 110. The cap 105 includes a side wall in which is formed a key slot 111 similar to the key slot 88 of the structure 60 which is employed in a similar manner thereto to release the latch mechanism 106.

The spray actuator 101 integrally molded with the closure structure 100 provides tamper evidence regarding any product housed in a container 109 on which the structure 100 is affixed. In order to release a product within the container 109, the actuator 101 must first be twisted to break the ribs 103 to thereby free the actuator 101. A prospective buyer of a product packaged in the container 109 may be alerted by a warning on the container 109 or cap 105 to inspect the ribs 103 for prior tampering before purchasing the product. In most other respects, the closure structure 100 is substantially similar to the structure 60.

It is to be understood that while certain forms of the present invention have been illustrated and described herein, it is not to be limited to the specific forms or arrangement of parts described and shown.

What is claimed and desired to be secured by Letters Patent is as follows:

1. A captive key release closure structure for a container, said structure comprising:

(a) closure base means for connection to said container;

(b) a closure member having at least one open position and a closed position;

(c) hinge means connecting said closure member to said base means to enable pivoting said closure member between said closed position and said open position;

(d) cooperating latch means on said base means and said closure member to releasably retain said closure member in said closed position; said latch means including indentation means and pawl means aligned such that when said closure member is in the closed position thereof, said pawl means is interferingly received in said indentation means at a substantial angle relative to a direction of opening of said closure member from the closed position to an open position thereof, so that said pawl means must be forceably biased by a user from the indentation means in order to move the closure member to an open position thereof; and (e) key slot means formed on at least one of said closure member and said base means and positioned at an interface therebetween when said closure member is in said closed position, said key slot means being adapted to receive key means operable to pry said closure member away from said base means to thereby release said latch means and allow said pivoting of said closure member.

2. A structure as set forth in claim 1 wherein:

(a) said latch means is hidden from view within said structure when said closure member is in said closed position.

3. A structure as set forth in claim 1 wherein said latch means includes:

(a) base wall means extending circumferentially along at least a portion of and near a periphery of said base means;

(b) closure wall means extending circumferentially along at least a portion of and near a periphery of said closure member;

(c) said indentation means are formed in one of said wall means; and (d) said pawl means are formed on the other of said wall means and, when in said closed position, said pawl means projects into said indentation means at an angle of approximately ninety degrees relative to the direction of opening of said closure member.

4. A structure as set forth in claim 3 wherein:

(a) said base means includes a radially inwardly directed recess; and (b) said key slot means is formed in said closure wall means at a position to align with said recess.

5. A structure as set forth in claim 4 wherein said latch means includes:

(a) a pair of pawls formed on a radially inner surface of said closure wall means on opposite sides of said key slot means; and (b) a pair of indentations formed on a radially outer surface of said base wall means and positioned to align respectively with said pawls, said indentations respectively receiving said pawls in said closed position of said closure member to thereby latch same in said closed position.

6. A structure as set forth in claim 4 wherein said latch means includes:

(a) said base wall means having a base surface, at least a portion of said base surface being frustoconical;

(b) said closure wall means having a closure surface, at least a portion of said closure surface being frustoconical; and (c) said base surface and said closure surface being positioned and oriented whereby the respective frustoconical surfaces thereof engage in said closed position of said closure member to thereby latch same in said closed position.

7. A structure as set forth in claim 1 wherein said latch means includes:

(a) said pawl means projecting from said base means at a position substantially opposite said hinge means; and (b) said indentation means formed on an inner surface of said closure wall means and positioned to engage said pawl means in said closed position of said closure member.

8. A captive key release closure structure for a container, said structure comprising:

(a) a base ring for connection to said container having a central axis;

(b) a closure member having at least one open position and a closed position;

(c) hinge means connecting said closure member to said base ring to enable pivoting said closure member between said closed position and said open position;

(d) a base wall extending circumferentially along at least a portion of and near a periphery of said base ring;

(e) a closure wall means extending circumferentially along at least a portion of and near a periphery of said closure member;

(f) cooperating latch means on said base ring and said closure member to releasably retain said closure member in said closed position; said latch means including pawl means and catch means; said pawl means engaging said catch means at a substantially angle relative to said ring central axis such that said pawl means interferingly engages said catch means and must be forceably biased past said catch means by a user when moving said closure member from said closed position to an open position thereof; and (g) a key slot formed on at least one of said closure member and said base ring and positioned at an interface therebetween when said closure member is in said closed position, said key slot being adapted to receive key means operable to pry said closure member away from said base ring to thereby release said latch means and allow said pivoting of said closure member such that said closure member is child resistant when in the closed position thereof.

9. A structure as set forth in claim 8 wherein:

(a) said latch means is hidden from view within said structure when said closure member is in said closed position.

10. A structure as set forth in claim 8 wherein said latch means includes:

(a) said indentation means formed in said base wall; and (b) pawl means formed on said closure wall, said pawl means being positioned to engage said indentation means in said closed position of said closure member.

11. A structure as set forth in claim 8 wherein:

(a) said base ring includes a radially inwardly directed recess; and (b) said key slot is formed in said closure wall at a position to align with said recess.

12. A structure as set forth in claim 8 wherein said latch means includes:

(a) a pair of pawls formed on a radially inner surface of said closure wall on opposite sides of said key slot; and (b) a pair of indentations formed on a radially outer surface of said base wall and positioned to align respectively with said pawls, said indentations respectively receiving said pawls in said closed position of said closure member to thereby latch same in said closed position.

13. A structure as set forth in claim 8 wherein said latch means includes:

(a) said base wall having a base surface, at least a portion of said base surface being frustoconical;

(b) said closure wall having a closure surface, at least a portion of said closure surface being frustoconical; and (c) said base surface and said closure surface being positioned and oriented whereby the respective frustoconical surfaces thereof engage in said closed position of said closure member to thereby latch same in said closed position.

14. A structure as set forth in claim 8 wherein:

(a) said hinge means is integral with said base ring and said closure member.

* * * * *